US008117979B2

(12) United States Patent
Kluge

(10) Patent No.: US 8,117,979 B2
(45) Date of Patent: Feb. 21, 2012

(54) RUDDER FOR SHIPS

(75) Inventor: Mathias Kluge, Hamburg (DE)

(73) Assignee: Becker Marine Systems GmbH & Co. (DE)

( * ) Notice: Subject to any disclaimer, the term of this patent is extended or adjusted under 35 U.S.C. 154(b) by 0 days.

(21) Appl. No.: 12/152,457

(22) Filed: May 14, 2008

(65) Prior Publication Data

US 2008/0314303 A1 Dec. 25, 2008

(30) Foreign Application Priority Data

Jun. 21, 2007 (DE) ..... 20 2007 008 804 U
Dec. 7, 2007 (EP) ..... 07 023 719

(51) Int. Cl.
*B63H 25/06* (2006.01)

(52) U.S. Cl. ..... 114/162

(58) Field of Classification Search ..... 114/162, 114/165, 169, 163, 167; 440/66, 71
See application file for complete search history.

(56) References Cited

U.S. PATENT DOCUMENTS 4,024,827 A * 5/1977 Becker ..... 114/162

FOREIGN PATENT DOCUMENTS

| | | | |
|---|---|---|---|
| DE | 25 55 098 | | 3/1977 |
| DE | 38 14 943 | | 12/1988 |
| EP | 0 051 822 | | 5/1982 |
| EP | 0 170 919 | A1 | 2/1986 |
| EP | 0 170 919 | B1 | 2/1986 |
| EP | 170919 | A1 * | 2/1986 |
| JP | 63188596 | A * | 8/1988 |
| JP | 2000185693 | | 7/2000 |

* cited by examiner

*Primary Examiner* — Edwin Swinehart
(74) *Attorney, Agent, or Firm* — Kelly & Kelley, LLP

(57) ABSTRACT

A rudder (1) for ships with a swivellable rudder blade (2) and a fin (3) hinged thereon as well as with a fin control device (S) having control elements which is placed outside the rudder blade (2) in bearing vicinity between a hull (6) and the rudder blade (2), it is provided that protecting guiding elements (L) are fixed to a ship part laterally from the control elements for the protection of the fin control against external influences such as pressure, stroke and impact shock.

10 Claims, 6 Drawing Sheets

RUDDER FOR SHIPS

BACKGROUND OF THE INVENTION

1. Field of the Invention

The present invention relates to a rudder for ships with a rudder blade (2) swivellable due to a bearing (4) and a fin (3) linked thereon, a fin control device (S) comprising control elements (10, 11, 12) which are placed outside the rudder blade (2) in the vicinity of the bearing between a hull (6) and the rudder blade (2), 2. Description of the Related Art A rudder for water vehicles is known from the German publication laid to public inspection 25 55 098. The rudder is placed below the hull and comprises a rudder blade with a rudder post and a fin positioned swivellable on the rudder blade. The fin is swivellable by control elements. The rudder blade is supported due to a rudder trunk bearing.

In this known solution, it is disadvantageous that the fin control is not protected against external influences such as pressure, strokes or impact shock.

SUMMARY OF THE INVENTION

The object of the invention is to improve the rudder in such a manner that the fin control is protected against external pressure, strokes or impact shock.

This aim is achieved by a rudder in which protecting guiding elements (L) are fixed to a ship part laterally from the control elements (10, 11, 12).

Due to the protecting elements according to the invention, the fin control is effectively and easily protected against external influences.

Strokes or impact strokes are practically absorbed by the protecting elements so that no damaging of the fin control is possible.

Moreover, the purpose of the additional leading elements is to lead the water flow, in particular when according to a preferred embodiment of the invention the protecting leading elements are configured as guide plates or spoilers. These elements are preferably fixed to a fixed ship part. Due to this embodiment, the leading elements lead the water of the propeller outgoing flow so as to pass by the control elements so that whirls are then avoided in the area of the control elements.

Since a very high pressure can arise in the area of the protecting elements due to the propeller drive, it is favorable when they are fixedly anchored on the hull so that the guiding sheets do not have any negative influence onto the rudder property even in case of a strong water flow caused by the ship propeller.

This effect is improved if the protecting guiding elements are curved or formed favorably for the water flow. The flow property of the ship is then improved on the whole because swirls are reduced to a minimum in the rudder area.

Moreover, an inexpensive fixing solution results when the protecting guiding elements are formed L-shaped, namely with a first leg which is designed as a fixing leg and a second leg which is designed as a guiding leg. The fixing leg bent by 90° can be for example welded on the hull. Due to the enlarged fixing surface, a multitude of welding points or a solid fixing can be realized.

According to a further advantageous improvement of the invention, the bearing is configured as a rudder trunk bearing configured as a cantilever bearing which is fixedly connected with its end with the hull and which is provided with an inner bore for receiving a rudder post. This solution has shown to be a solid and proved construction.

Basically the fin motion is depending on the rudder motion so that the fin is always swiveled opposite to the rudder. In an alternative of the invention, the fin control device is designed in such a way that the fin is swivellable independently from the control of the rudder blade. Thus, for example very quick and precise turning maneuvers. Due to the slight inertia of the fins with respect to the rudder, they can carry out very quick changes in direction.

If the fin is moved by means of hydraulic adjusting elements or of other sensitive devices, the protecting plates can be optimally used.

Further advantageous configurations of the invention are characterized in the subclaims.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figures 1, 1B:
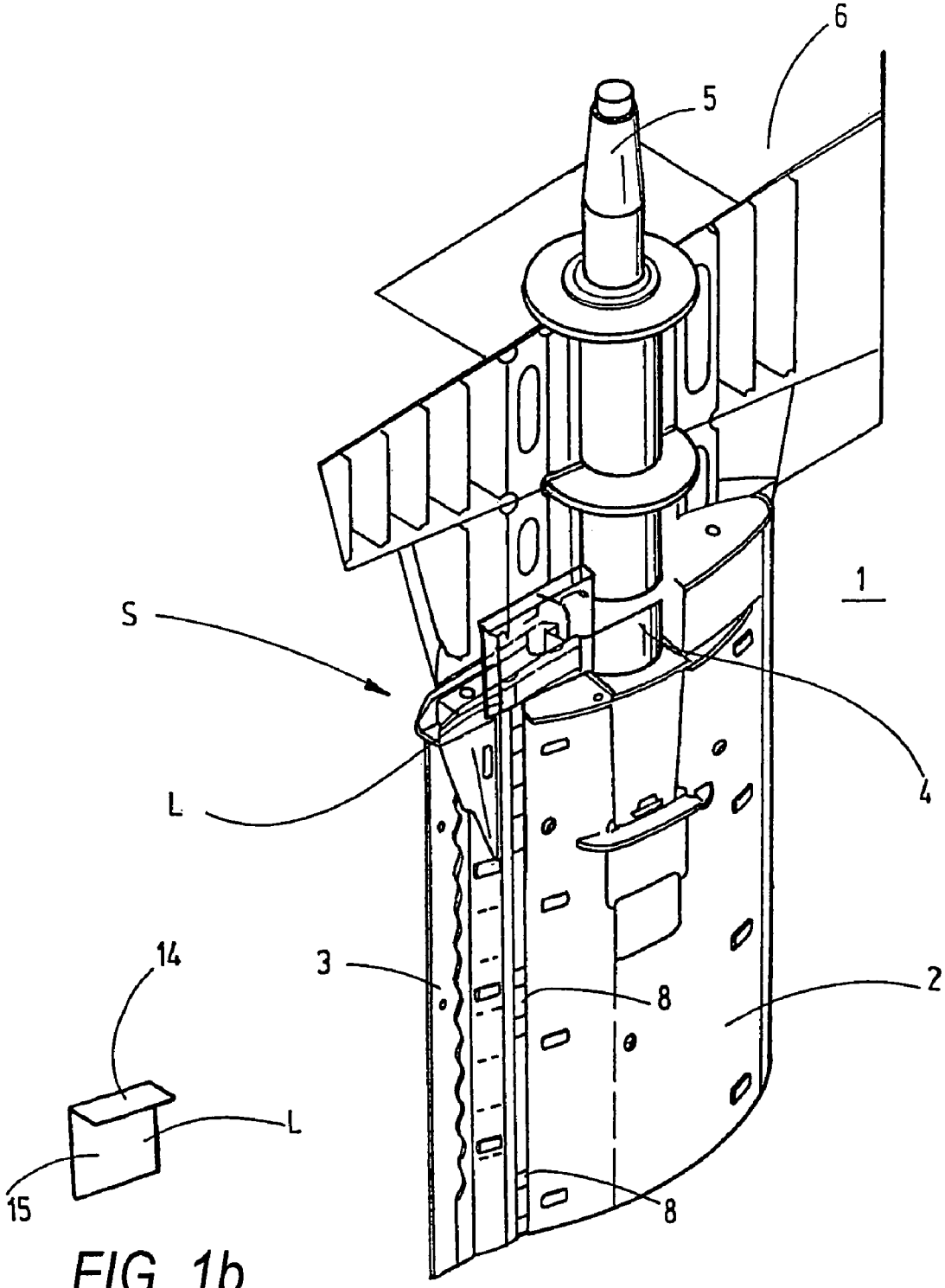
FIG. 1 is a perspective illustration of a rudder.
FIG. 1*b* is a graphical illustration of a guiding sheet.

The same parts are indicated with the same reference numerals in the figures.

FIG. 1 shows a rudder 1 according to the invention for ships. The rudder 1 comprises a rudder blade 2 and a fin 3 linked thereon. The rudder blade 2 is connected as a hinge with the rudder fin over its length, whereby there are several intermeshing hinge studs 8 through which one or several hinge bolts which cannot be seen go through.

The rudder 1 or the rudder blade is swivellable over a bearing 4 which can be designed in a known way, for example as a rudder trunk bearing. The rudder blade 2 is rotatable around a rudder post 5 which extends from the hull 6 into the profile of the rudder blade 2.

Figure 2:
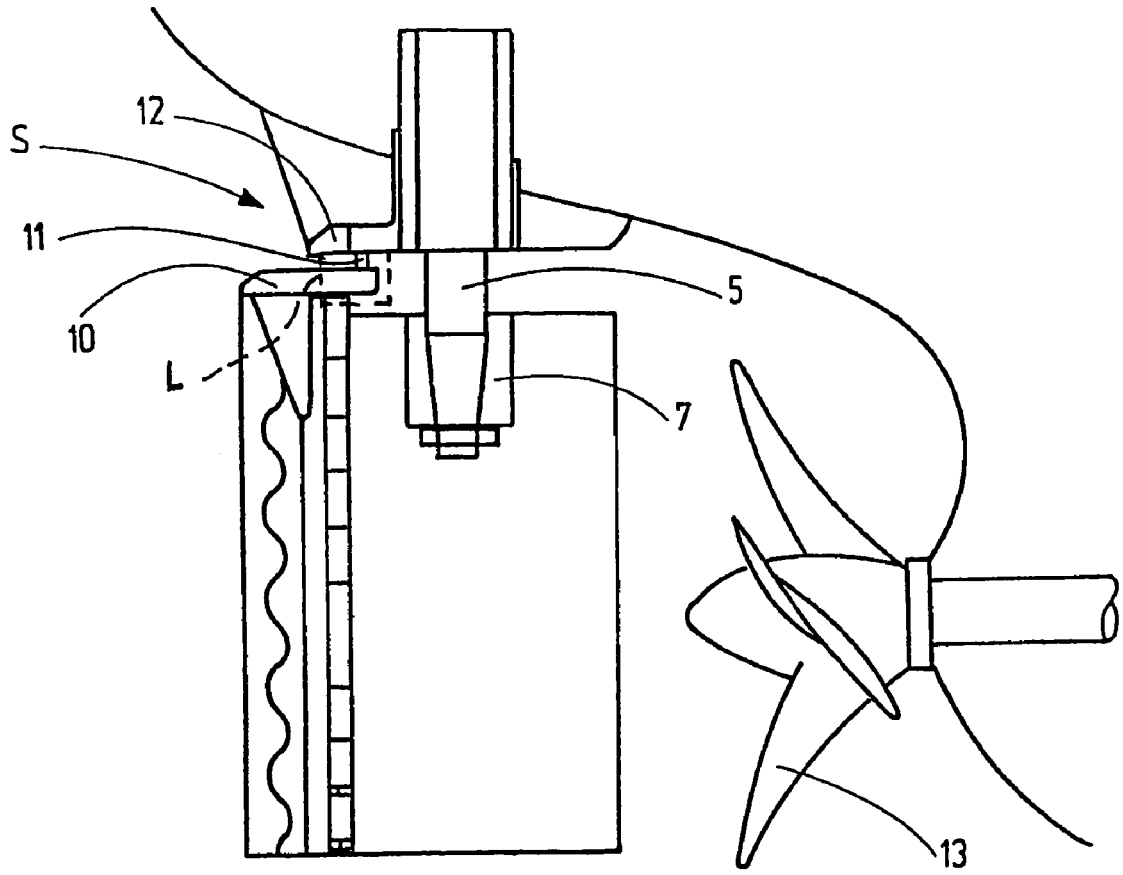
FIG. 2 is a side view of the rudder.

The rudder as a fully balanced rudder is preferably provided with a cone coupling 7 as it is shown in FIG. 2. The shown rudder is designed as a so-called balance profile rudder.

Furthermore, the rudder is provided with a fin control device S comprising control elements 10, 11, 12. This device is placed outside the rudder blade 2, namely at proximity of the bearing between the hull 6 and the rudder blade 2.

The fin control device S moves the fin 3 in opposite direction to the motion of the rudder blade so that the rudder acts like bent by maneuvers and thus develops a better rudder effect. The fin control device S is made of a fin bracket 10, a hull bracket 12 and a connection bolt 11 which allows a rotation of the fin bracket 10. The wished fin motion develops by retaining the fin bracket 10 in the area of the connection bolt 11.

Figure 3:
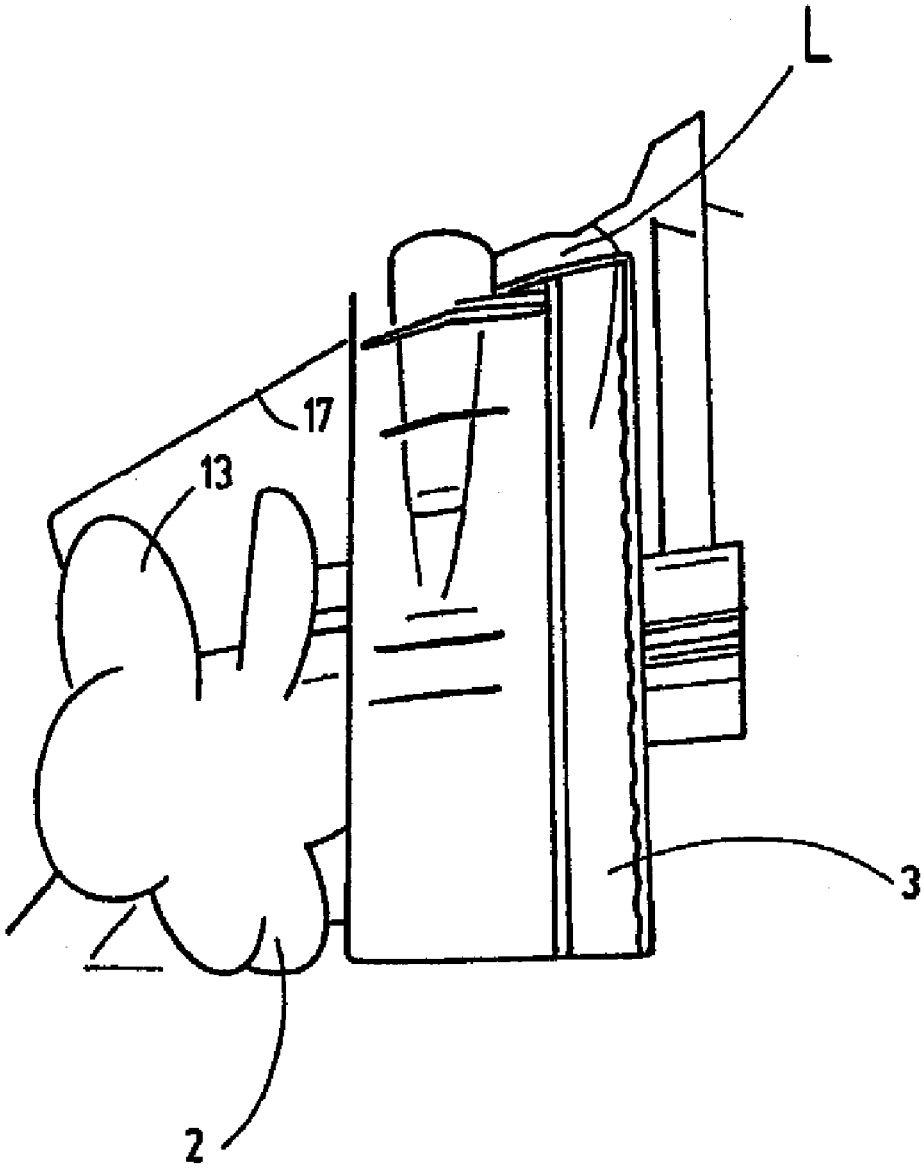
FIG. 3 is a further perspective illustration of the rudder.
Figure 4:
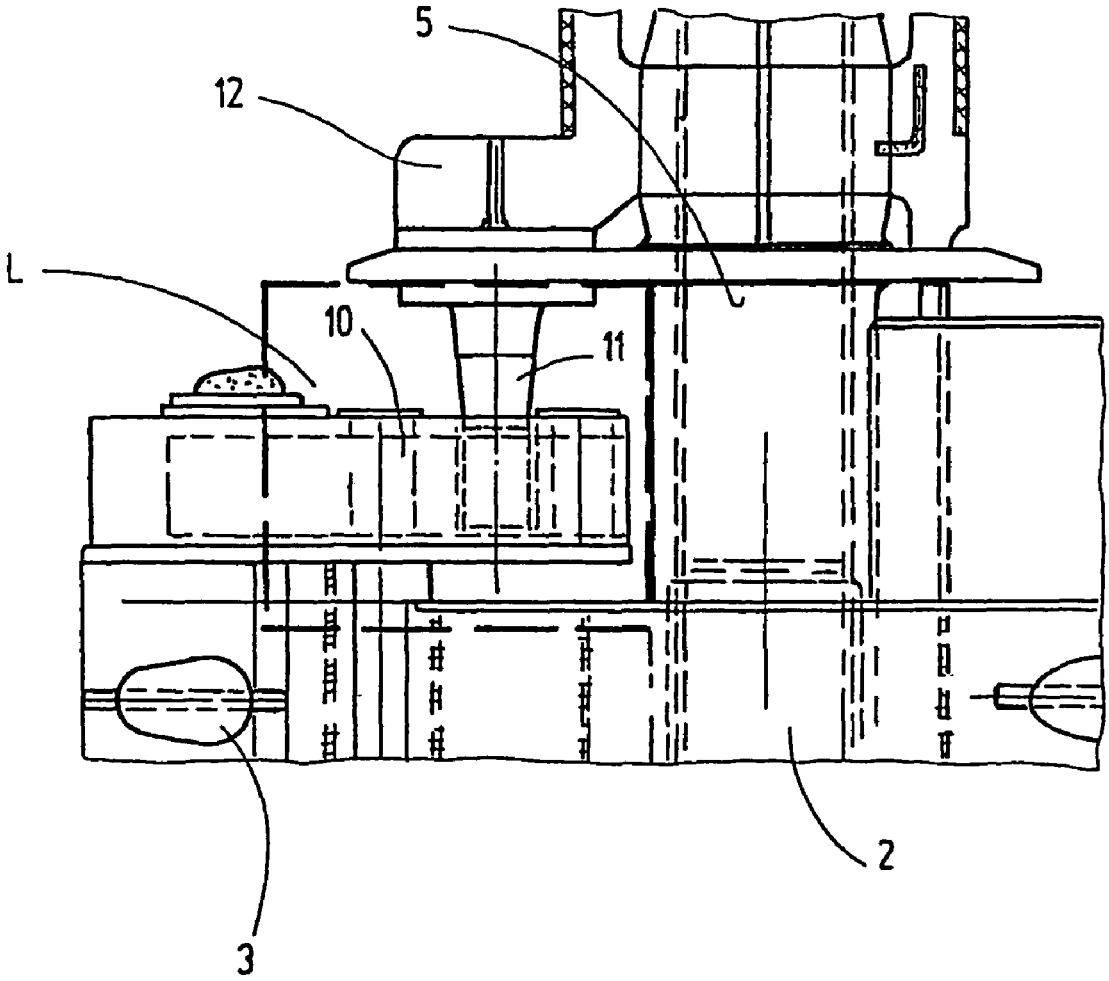
FIG. 4 is an enlarged view of the fin control device.

As FIG. 3 illustrates, a ship propeller 13 is placed in close vicinity of the rudder 1, namely below the hull 17 and between the hull 6 and the rudder 1. Thus, the rudder 1 is flown through by a stronger water flow during the ship motion.

According to the invention, protecting elements L are fixed on a ship part, namely in particular on the hull 6 itself, immediately laterally adjacent to the control elements 10 to 12. Preferably, a single protecting guiding element L which covers the fin control device S does exist for each side, as the figures show.

Preferably the protecting guiding elements are designed as guiding sheets or spoilers which are fixed on a fixed ship part or on the hull 17 and which are thus fixedly anchored.

The guiding sheets L protect the control elements 10 to 12 against damage, for example due to pressure or impact shock.

The guiding sheets L can be bent favorably to the water flow. They are for example formed round around the fin control device S so that the water flow passes by it. This causes little swirls which results in an increased efficiency.

As FIG. 1*b* shows, in which a single guiding sheet L is shown, this guiding sheet is formed L-shaped. It is provided with a first leg 14 which is designed as a fixing leg and which is provided with a second leg 15 which is designed as guiding leg. The guiding leg serves as a protecting plate.

Figure 5:
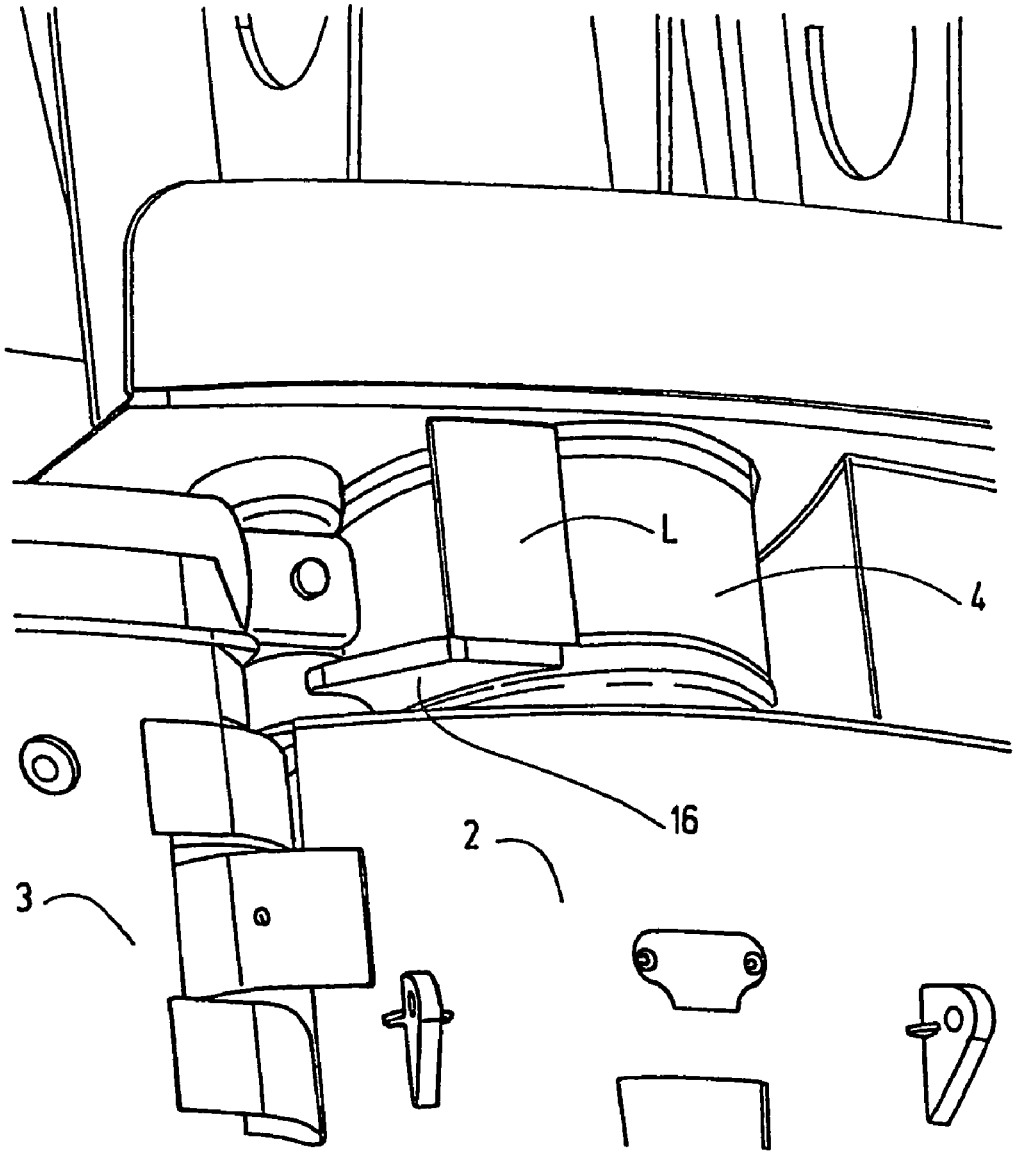
FIG. 5 is a first enlarged perspective illustration of the protecting guiding element.
Figure 6:
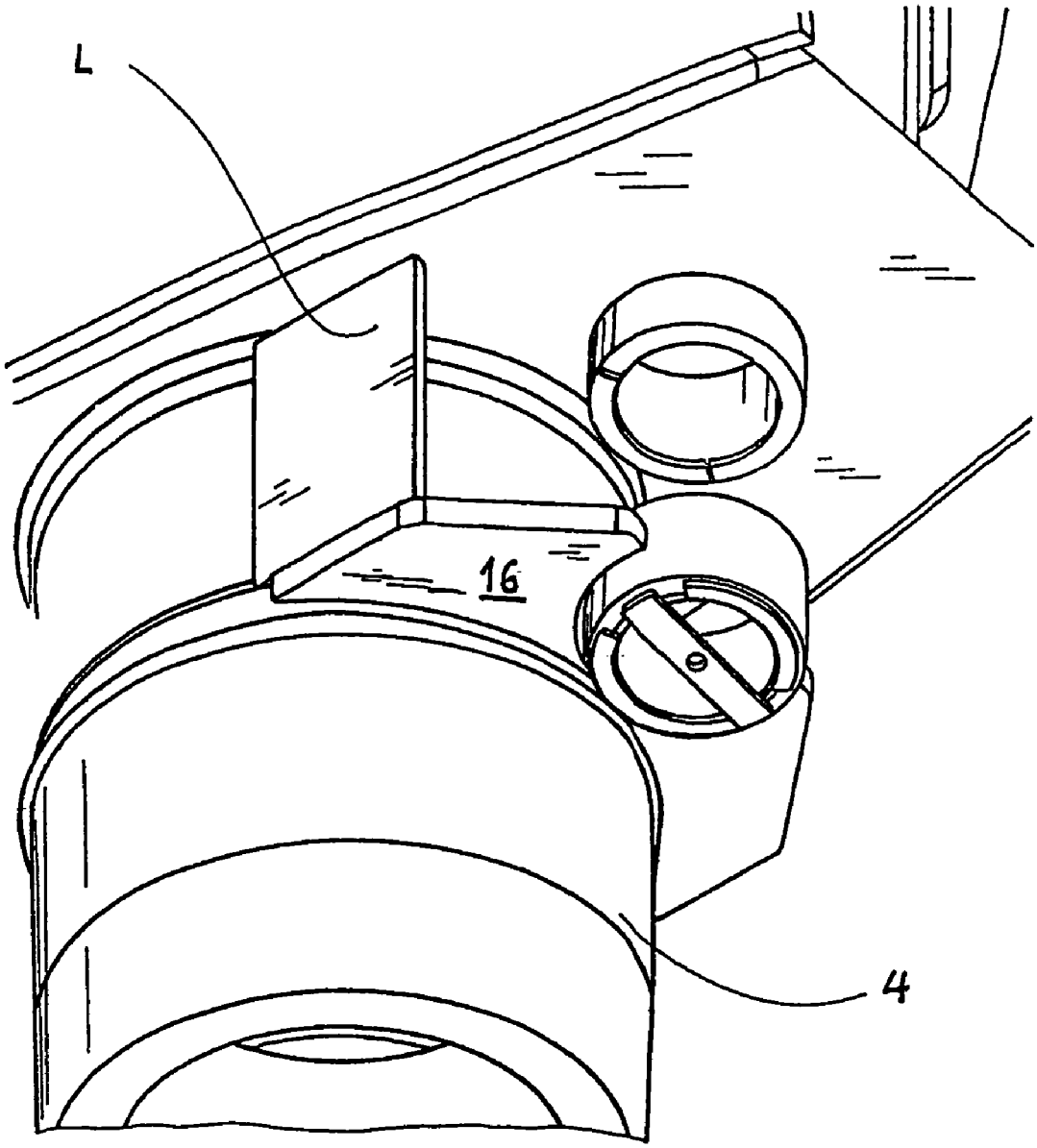
FIG. 6 is a second enlarged perspective illustration of the protecting guiding element.

As FIGS. 5 and 6 show, the guiding sheet L can also be plate-shaped. It must not be relatively long either. At the lower end of the guiding sheet L, this sheet is fixed for example to a fixed side bracket 16, whereby the view in FIG. 6 is from below.

The invention is not limited to this example. The rudder can also have another bearing connection.

The bearing is for example configured as a rudder trunk bearing which is fixedly connected with the hull with its end and which is provided with an inner bore which receives a rudder post. However, other embodiments of the rudder are also possible.

The fin control device can also be designed in such a manner that the fin is swivellable independently from the control of the rudder blade. Electric or hydraulic solutions can thus be used.

The protecting guiding sheets are preferably placed and configured in such a manner that, for a rudder blade position for a straight course of the ship, the protecting guiding elements are aligned with the side walls of the rudder blade 2 or are situated in the extension of the side walls of the rudder blade 2 so that there cannot come to flow turbulences in the propeller outgoing flow in the transition area between the protecting guiding elements and the side walls of the rudder blade 2.

While specific embodiments of the invention have been shown and described in detail to illustrate the inventive principles, it will be understood that the invention may be embodied otherwise without departing from such principle.

I claim:

1. A rudder for ships comprising a rudder blade swivellable due to a bearing and a fin swivellably linked thereon, a fin control device placed outside the rudder blade controlling swivellable movement of the fin relative to the rudder blade and located in the vicinity of the bearing between a hull and the rudder blade, and protecting guiding elements configured as guide plates for leading water of a propeller outgoing flow past the fin control device and are fixed relative to a part of the ship laterally adjacent to the fin control device, wherein the protecting guiding elements are so placed and configured that, for a rudder blade position for a straight course of the ship, the protecting guiding elements are aligned with each of a side wall of the rudder blade, and wherein the fin control device is not sealed from water.

2. The rudder according to claim 1, wherein the protecting guiding elements are fixedly anchored to the hull.

3. The rudder according to claim 1, wherein the protecting guiding elements are formed L-shaped with a first leg which is designed as a fixing leg and a second leg which is designed as a guiding leg.

4. The rudder according to claim 1, wherein the bearing is configured as a rudder trunk bearing configured as a cantilever bearing which is fixedly connected with its end with the hull and which is provided with an inner bore which receives a rudder post.

5. The rudder according to claim 1, wherein the rudder as a fully balanced rudder is provided with a cone coupling.

6. The rudder according to claim 1, wherein the protecting guiding elements are immediately laterally adjacent to the fin control device.

7. A balanced profile rudder comprising a rudder blade swivellable due to a bearing and a fin swivellably linked thereon, a fin control device placed outside the rudder blade controlling swivellable movement of the fin relative to the rudder blade and located in the vicinity of the bearing between a hull and the rudder blade, and protecting guiding elements configured as guide plates for leading water of a propeller outgoing flow past the fin control device and are fixed to a ship part laterally adjacent to the fin control device, wherein the protecting guiding elements are so placed and configured that, for a rudder blade position for a straight course of the ship, the protecting guiding elements are aligned with each of a side wall of the rudder blade, and wherein the fin control device is not sealed from water.

8. The rudder according to claim 7, wherein the protecting guiding elements are immediately laterally adjacent to the fin control device.

9. A ship comprising a rudder with a rudder blade swivellable due to a bearing and a fin swivellably linked thereon, a fin control device placed outside the rudder blade controlling swivellable movement of the fin relative to the rudder blade and located in the vicinity of the bearing between a hull and the rudder blade, and protecting guiding elements configured as guide plates for leading water of a propeller outgoing flow past the fin control device and are fixed to a ship part laterally adjacent to the fin control device, further comprising a ship propeller placed between the hull and the fin, wherein the protecting guiding elements are so placed and configured that, for a rudder blade position for a straight course of the ship, the protecting guiding elements are aligned with each of a side wall of the rudder blade, and wherein the fin control device is not sealed from water.

10. The ship according to claim 9, wherein the protecting guiding elements are immediately laterally adjacent to the fin control device.

* * * * *